US007959025B2

(12) United States Patent
Salice

(10) Patent No.: US 7,959,025 B2
(45) Date of Patent: Jun. 14, 2011

(54) CONTAINER FOR SURPRISE GIFTS PRODUCED IN ONE PIECE

(75) Inventor: Giuseppe Salice, Arlon (BE)

(73) Assignee: Magic Production Group (M.P.G.) S.A., Senningerberg (LU)

( * ) Notice: Subject to any disclaimer, the term of this patent is extended or adjusted under 35 U.S.C. 154(b) by 1036 days.

(21) Appl. No.: 11/569,220

(22) PCT Filed: May 17, 2005

(86) PCT No.: PCT/EP2005/052253

§ 371 (c)(1),
(2), (4) Date: Nov. 16, 2006

(87) PCT Pub. No.: WO2005/110880

PCT Pub. Date: Nov. 24, 2005

(65) Prior Publication Data

US 2007/0172555 A1 Jul. 26, 2007

(30) Foreign Application Priority Data

May 18, 2004 (EP) ..... 04011710

(51) Int. Cl.
*B65D 6/28* (2006.01)

(52) U.S. Cl. ..... 220/4.21; 220/4.01; 220/4.22; 220/4.23; 220/810; 220/836; 426/106

(58) Field of Classification Search ..... 220/4.22, 220/4.23, 4.01, 4.21, 810, 836, 837, 840; 426/106

See application file for complete search history.

(56) References Cited

U.S. PATENT DOCUMENTS

| | | | | |
|---|---|---|---|---|
| 2,998,896 | A | 9/1961 | Miller | |
| 3,043,354 | A | 7/1962 | Fitzgerald | |
| 3,907,103 | A | 9/1975 | Shaw | |
| 4,124,135 | A * | 11/1978 | Weder et al. | 220/4.21 |
| 4,403,712 | A | 9/1983 | Wiesinger | |
| 5,792,496 | A * | 8/1998 | Fekete et al. | 426/104 |
| 6,439,410 | B1 | 8/2002 | Dubach | |
| 6,971,531 | B1 * | 12/2005 | Dubach | 215/235 |

FOREIGN PATENT DOCUMENTS

| | | | |
|---|---|---|---|
| DE | 7436695 | U | 2/1975 |
| EP | 0331940 | A2 | 9/1989 |
| EP | 0720950 | A1 | 7/1996 |
| EP | 1308392 | A1 | 5/2003 |
| JP | 57-502163 | A | 12/1982 |
| JP | 2001-171711 | A | 6/2001 |
| WO | 9300267 | A1 | 1/1993 |

* cited by examiner

*Primary Examiner* — Anthony Stashick
*Assistant Examiner* — Elizabeth Volz
(74) *Attorney, Agent, or Firm* — Rothwell, Figg, Ernst & Manbeck, P.C.

(57) ABSTRACT

A description is given of a container for products such as surprise gifts or similar accessories, comprising two half-shells (2, 4) with a containing wall and a mouth (10, 12) capable of being joined mouth to mouth, fitting together at the front, to form a closed container. The two half-shells (2, 4) are hinged one to the other by hinge means (20) integral with the two half-shells, in such a way that one of the halfshells (2) can move with a snap action relative to the other half-shell (4) between a closed position of the container and an at least partially open position of the container.

20 Claims, 5 Drawing Sheets

Fig.1
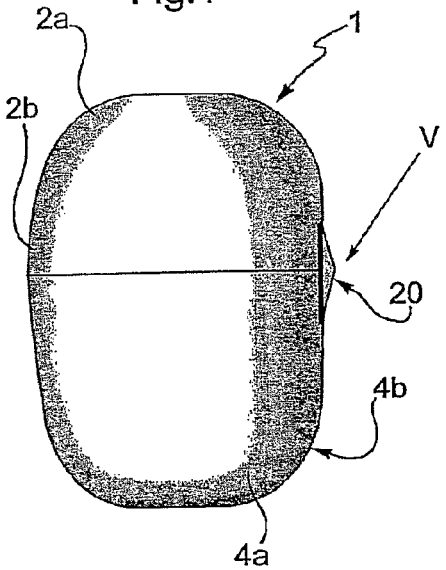
Fig.2
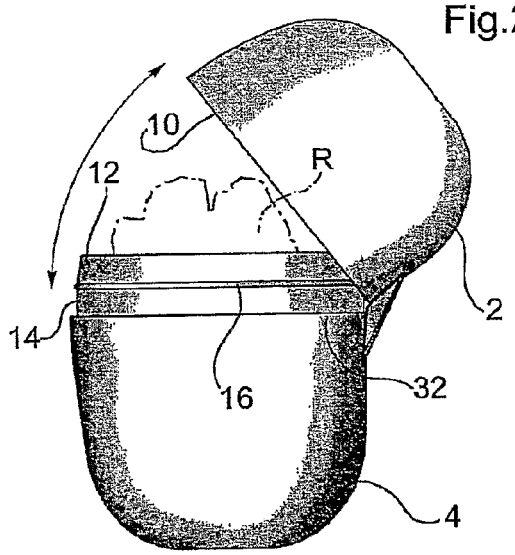
Fig.3
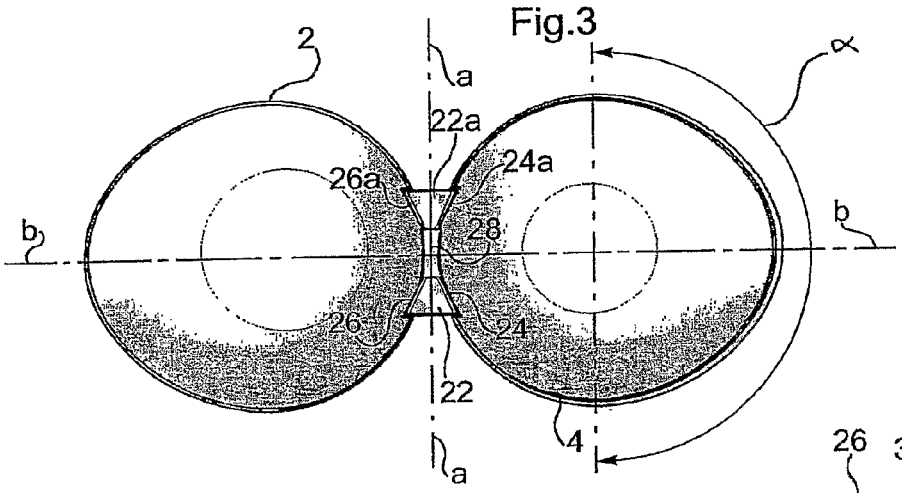
Fig.4
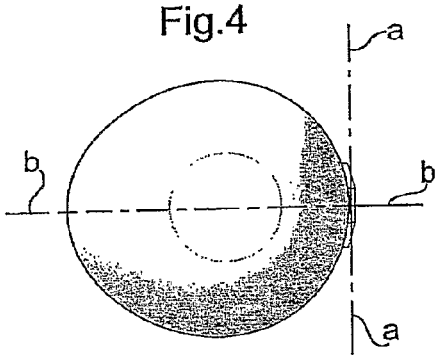
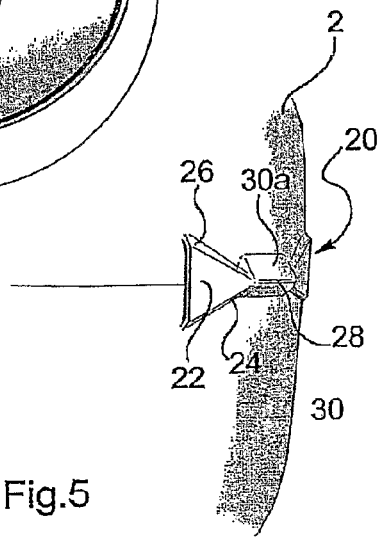
Fig.5

CONTAINER FOR SURPRISE GIFTS PRODUCED IN ONE PIECE

CROSS REFERENCE TO RELATED APPLICATION

This application is a 35 U.S.C. §371 National Phase Entry Application from PCT/EP2005/052253, filed May 17, 2005, and designating the United States.

The present invention relates to a small container for products, such as in particular surprise gifts and similar articles or accessories, that is to a container adapted to be used to insert inside it gift articles such as, for example, small toys or confectionery products, and adapted to be introduced inside a hollow body of edible material such as a chocolate egg or inside a packaging comprising edible material.

In particular, the invention relates to a container of the type described in WO-A93/00267 or in EP-A-1 308 392, comprising two half-shells having a containing wall and an open mouth, capable of being joined mouth to mouth so that the front parts fit together to form a closed container which is to be opened by the consumer to extract the gift article contained in it.

One purpose of the invention is to supply a new container of the type indicated above having improved characteristics for use by the consumer, in particular greater compactness and ease of handling, and also being easier and more convenient to open and close.

Another purpose of the invention is to supply a container in which the two half-shells constituting respectively the bottom and the lid are connected to each other in such a way that they are not easily separated.

A further purpose of the invention is to supply a container which can be manufactured advantageously from the economic point of view.

In view of these purposes, a subject of the invention is a container as defined in the claims which follow.

Another subject of the invention, defined in the claims, is a package made of a food product, for example a package in the form of a chocolate egg containing inside it a container enclosing a gift or surprise article according to the above-mentioned first subject of the invention.

Other characteristics and advantages of the invention will become clear from the following detailed description which is given with reference to the appended drawings which are provided purely by way of non-limiting example and in which:

FIG. 1 is a front view of a container according to the invention;

FIG. 2 is a front view of the container in FIG. 1 in a partially open configuration;

FIG. 3 is a view from above of the container in FIG. 1 in a completely open configuration in which one of the two half-shells is swung back by about 180°;

FIG. 4 is a view of the container from above, in the closed configuration in FIG. 1;

FIG. 5 is a partial view of a detail indicated by the arrow V in FIG. 1;

With reference to the drawings, an integral container according to the invention, indicated as a whole by the number 1, comprises a first and a second half-shell 2, 4, generally of injection moulded or thermoformed plastics material.

In the examples of embodiment shown, each of the two half-shells 2, 4 have a generally cup-like configuration, with a containing wall comprising a cap-shaped end portion, optionally flattened at the top, 2*a* and 4*a*, and a skirt portion 2*b* and 4*b*.

Figure 6:
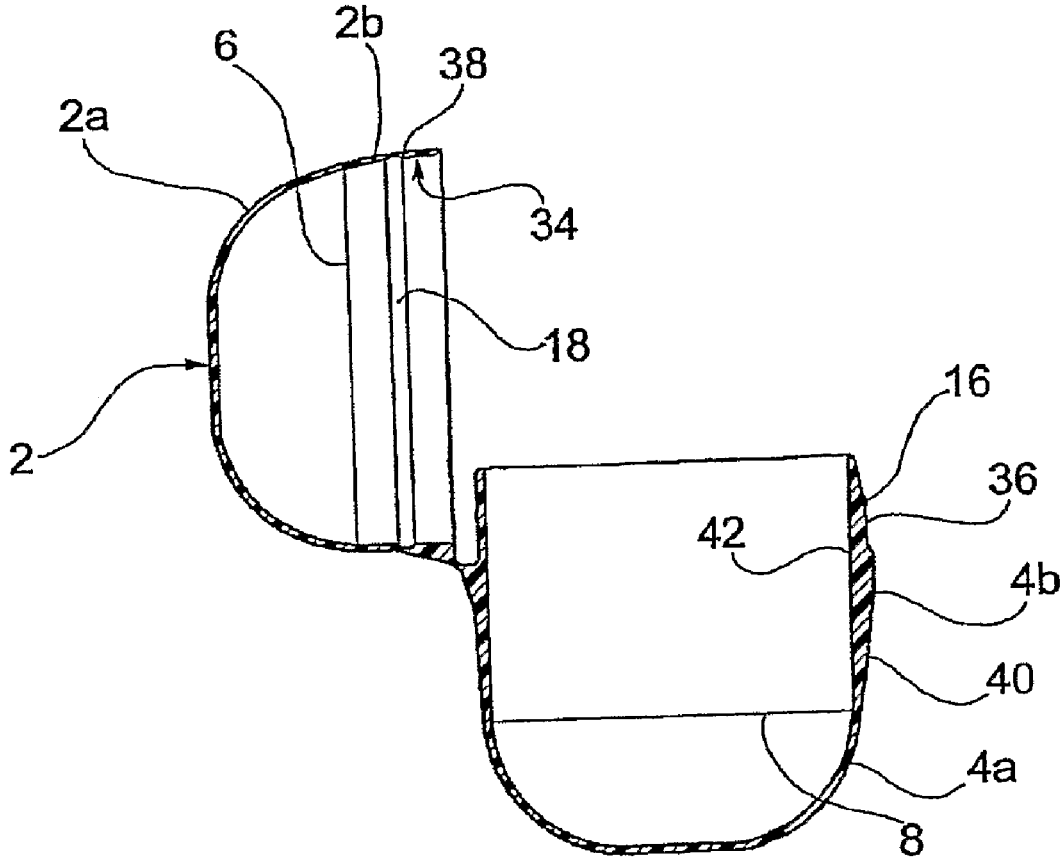
FIG. 6 is a sectional view of the container in FIG. 1 in an open configuration, in which one of the two half-shells is swung back by about 90°.

The division between the cap-shaped portion and the skirt portion is identified in the cross-section in FIG. 6 by the lines 6 and 8; however, this is a purely imaginary division, indicating that there is possibly but not necessarily a point or area of transition between portions of the inner or outer surface of the containing wall, having different curvatures, for example a portion with a curved shape in vertical section and a portion which is substantially rectilinear in shape or has less curvature.

Bearing in mind the optional nature of the above-mentioned division, in what follows the term skirt or skirt portion will also be used to indicate the annular side of wall portion adjacent to the mouth of the respective half-shell.

In the example of embodiment shown, the two half-shells have a mouth, respectively 10 and 12, with a circular outline or, as shown in more detail in what follows, a substantially circular outline.

However, it should be understood that the constructional principle of the invention may also be applied to half-shells having a different mouth outline, for example elliptical, ovoid, polygonal or mixtilinear.

The two half-shells can be connected mouth to mouth so that the front parts fit together. In particular, one of the half-shells 4 has a neck 14 capable of being inserted or fitted into a portion of the side wall of the other half-shell 2 (skirt portion 2*b*), with an interference fit sufficient to prevent the two half-shells from easily being pulled apart from each other.

For the purpose of promoting a firm connection between the two half-shells, means may be provided for positive or snap fitting, comprising for example an annular rib 16 in the neck 14, which preferably has an angular or circumferential extension of less than 360° (FIG. 11) and which may be continuous or discontinuous and which engages with a complementary annular groove 18 (FIG. 6) made on the inner surface of the wall of the other half-shell 2 in the area where the two half-shells are superimposed.

It should be understood that other means of fitting together may be used, provided that they are suitable for making a firm connection which is nevertheless easily disengaged by the user.

The two half-shells 2 and 4 are connected to each other by hinge means, preferably of the snap-action type, integral with the two half-shells and indicated as a whole by the number 20. Integral snap-action hinge means of plastics material are known in themselves, particularly for hinging a closure lid to a stopper which can be fitted, for example screwed on, to the neck of a bottle or similar small container.

The present invention should not be understood as limited to the choice of a particular type of snap-action hinge means; the description which follows therefore refers to preferred embodiments which make it particularly easy to hinge the two half-shells and join them together in the front-fitting configuration previously described.

In the example shown in FIGS. 1 to 6, the snap-action integral hinge means 20 comprise at least one intermediate element 22 which is connected to the side wall of one half-shell 4 by means of a first film hinge 24 and to the side wall of the other half-shell 2 by means of a second film hinge 26, where the film hinges 24, 26 are divergent from each other and extend obliquely relative to the main hinging axis shown by a-a in FIG. 3 towards which they converge.

It should be understood that the film hinges 24, 26 have a smaller wall thickness compared with the wall thickness of the intermediate element 22 and may follow a rectilinear or curved line.

Said film hinges 24, 26 are divergent outwards and converge towards the main hinging axis a-a and meet, or their extensions meet, at a point on the main hinging axis.

Preferably, the integral snap-action hinge comprises two pairs of film hinges, namely the above-mentioned first pair 24, 26 and a second pair 24*a*, 26*a*, connected to a second intermediate element 22*a*.

Preferably, provision is made for a further film hinge element 28 which extends parallel to the main hinging axis a-a and which is connected to two half-shells by means of connecting elements 30 and 30*a*.

The longitudinal extension of the film hinge element 28 may vary widely and in particular may be reduced to a point coinciding or substantially coinciding with the point of intersection of the film hinges 24, 26 and 24*a*, 26*a*.

Thus, for example, the above-mentioned film hinges as a whole may have a configuration with two opposing V's, when the hinge element 28 is reduced to a point, or a double-Y configuration (two opposing Y's with a leg coinciding), it being understood that the line which the hinges 24, 26, 24*a* and 26*a* follow is not necessarily rectilinear, but may also be curved.

The connecting element 30 is connected to the half-shell 4 adjacent to or substantially flush with the edge 32 of the neck 14 and the connecting element 30*a* is connected to the half-shell 2 substantially adjacent to or flush with the mouth outline of said half-shell.

With the container in the closed configuration, the intermediate elements 22 and 22*a* rest against the walls of the half-shells. In this closed configuration, the film hinges 24, 26 and 24*a*, 26*a*, relatively elastic, are subjected to a tensile load and in turn apply a tensile load to the intermediate elements 22 and 22*a* which on the contrary are not elastic in tension or only weakly elastic, and in any case to a lesser degree compared with the film hinges.

Because of these characteristics, the opening of the container, by applying a tensile force to the upper half-shell 2 for example, which acts as a lid, causes the half-shell 2 to snap open, swinging back by about 180°.

In the embodiment of FIGS. 7 to 11, the integral snap-action hinge means 20 comprise a film hinge element 44 connected to the upper half-shell 2, acting as a lid, at its mouth outline 10, along a curved segment 46 and to the lower half-shell 4, immediately below the neck 14, along a curved segment 48; at the longitudinal ends (that is in a circumferential direction) of the film hinge element 44 there are elastic elements in the form of ribs 50, 52, projecting outwards and having a greater thickness compared with the film hinge element 44.

In this embodiment, preferably the side wall of the half-shell 2 has in its skirt portion 2*b* lines of weakening 54, 56, preferably parallel with each other, which extend vertically from the mouth outline 10 for a length of the side wall 2*b* of the half-shell and each arranged adjacent to a respective end in a circumferential direction of the film hinge element 44, that is in the immediate vicinity of the rib elements 50 and 52.

When the container is in the open configuration in which the upper half-shell 2 is swung back by about 180°, the hinge element 44 and the rib elements 50, 52 lie substantially in one plane.

When the container is in the closed position, the rib elements 50 and 52 are deformed elastically by bending in the form of a C.

Figure 11:
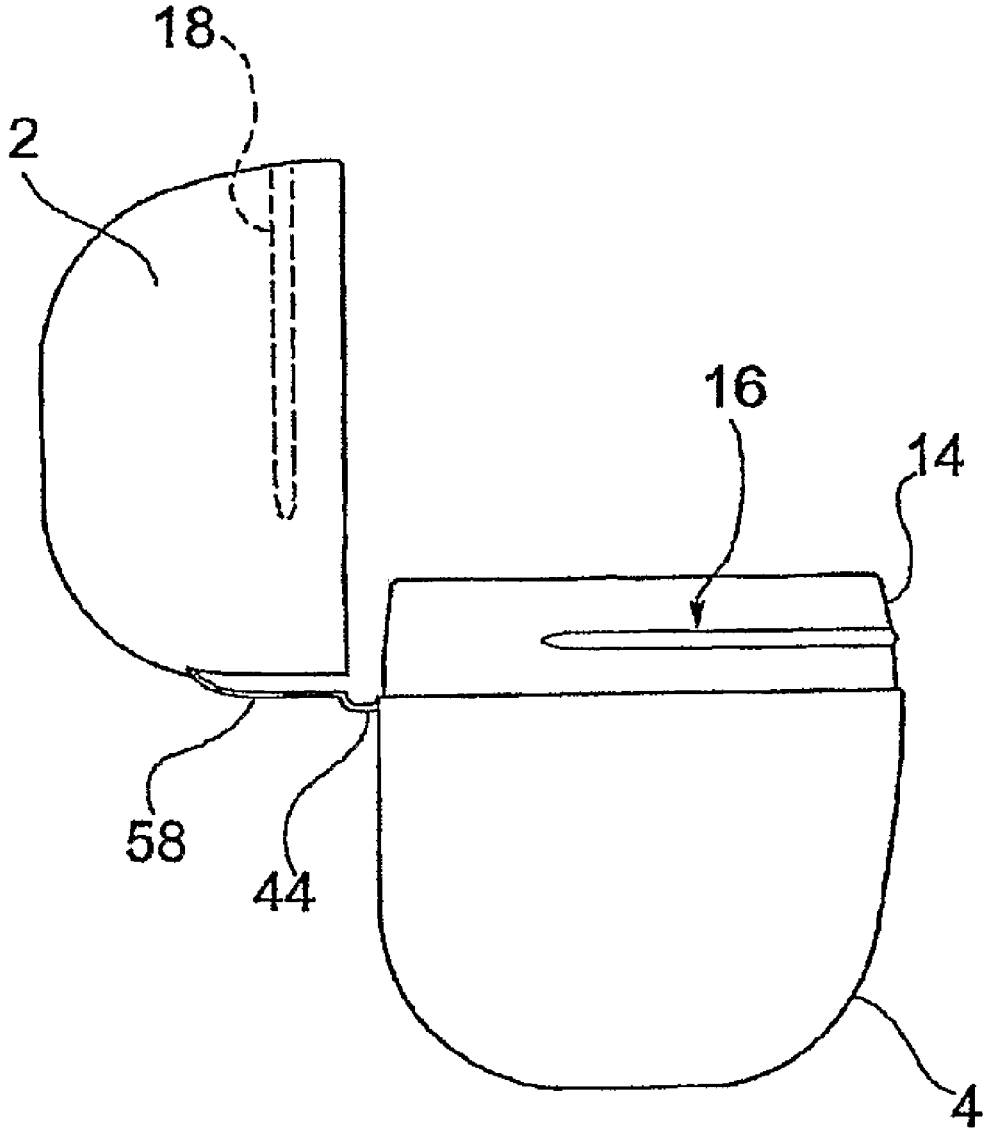
FIG. 11 is a front view of the container in FIG. 7 in an open configuration, in which one of the two half-shells is swung back by about 90°.

The container may be opened by applying an upwards tensile force to the upper half-shell 2, and also by applying compression or a radial crushing force to the side wall of the container, so that, because of the flexibility of the walls of the container, elastic deformation of this wall is caused which in turn causes disengagement of the positive fitting means 16, 18, present in the neck portion 14 and skirt portion 2*b* (FIG. 11).

Following this disengagement, the elastic return of stretching of the rib elements 50 and 52 causes half-shell 2 to snap open, swinging back by about 90°.

The lines of weakening 54, 56 have substantially the function of avoiding or reducing the risk that the loads, possibly repeated, applied to open and close the container may cause breakage of the hinge means with consequent undesirable separation of the two half-shells.

This is because the loads (in tension, compression or torsion) exerted on the wall of the half-shell 2 in the course of opening and/or closing the container first cause breakage of one or both lines of weakening 54, 56. When this occurs, the upper half-shell 2 remains hinged to the lower half-shell 4 by means of the hinge means 44, 50 and 52, connected to the area of side wall 58 in the form of a flap (FIG. 11), comprised between the cut lines of weakening.

The flap area 58 which, because of the flexibility of the side wall of the half-shell 2 also has high flexibility characteristics, acts as an extension of the hinge arm between the two half-shells. In the opening configuration of the container which occurs as a result of breakage of the lines of weakening (shown in FIG. 10), the upper half-shell 2 is thus also hinged to the half-shell 4 by means of the flap 58 and is capable of swivelling about a further horizontal hinge axis c-c (FIG. 7), substantially coinciding with the connecting segment 60 between the flap 58 and the hinge element 44.

Breakage of the weakening lines 54, 56 does not also impair the serviceability of the container which, in its closed configuration, maintains its containing function.

Figure 7:
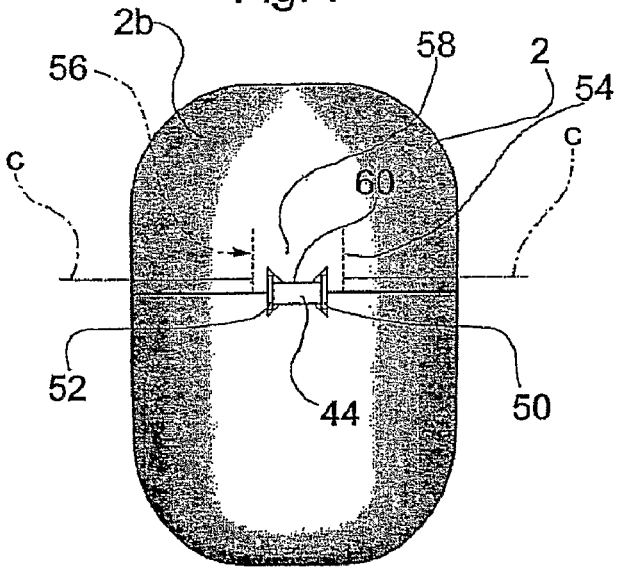
FIG. 7 is a front view of another embodiment of a container according to the invention.
Figure 12:
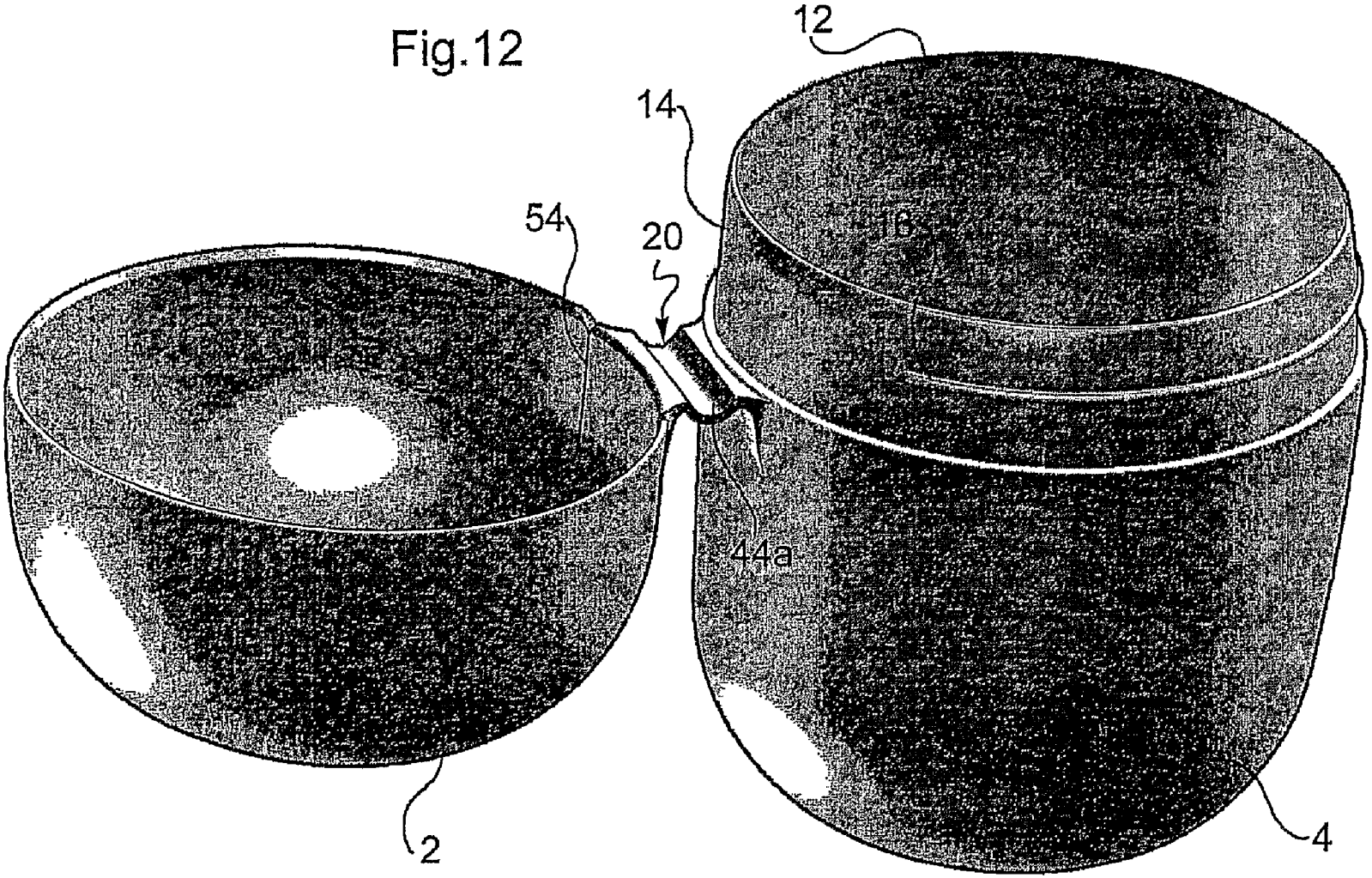
FIG. 12 is a perspective view of another embodiment of a container according to the invention.

The embodiment of FIG. 12 differs from that of FIG. 7 substantially by the fact that the integral hinge means 20 comprise a connecting element 44*a* which, even in the open configuration of the container with the half-shell 2 swung back by about 180°, is curved (C-shaped transverse section) rather than substantially flat.

In the embodiments described previously, it is preferable for the skirt portion 2*b* of the half-shell 2 or at least an angular area of it adjacent to or above the hinge means to be flexible or elastic in bending.

Preferably, the annular wall of the neck 14 is also flexible or elastic in bending; it is however preferable for the angular area of the annular wall of the neck 14, arranged on the opposite side relative to the hinge means 20, to be more rigid in bending or elastic deformation relative to the annular neck area adjacent to or above the hinge means and also more rigid relative to the skirt portion 2*b* of the half-shell 2.

These characteristics may be obtained by ensuring that at least one angular area $\alpha$ of the annular wall of the neck 14, and where appropriate of the adjacent skirt portion 4*b*, has a greater wall thickness compared with the wall thickness of the area of neck above the hinge means and also greater relative to the wall thickness of the skirt portion 2*b* of the half-shell 2.

Figure 8:
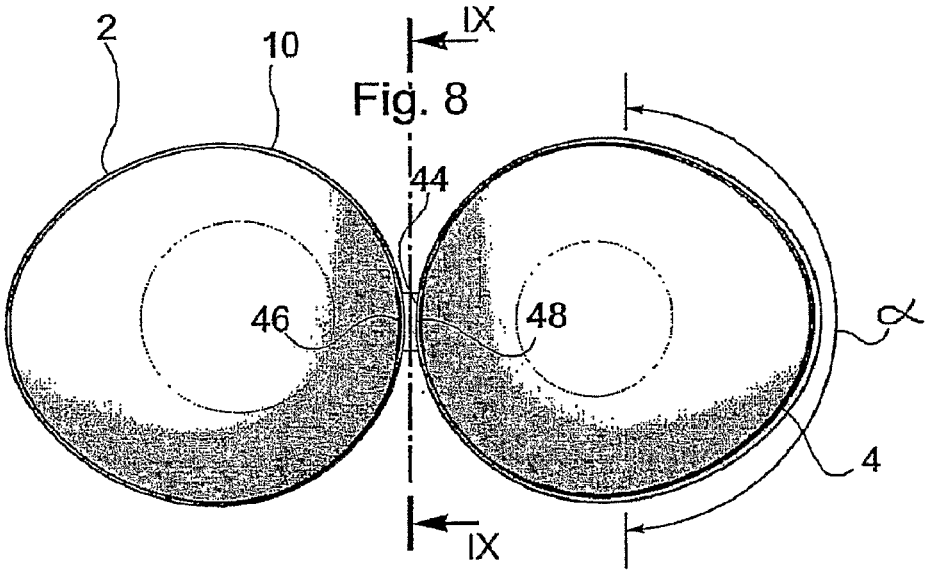
FIG. 8 is a view from above of the container in FIG. 7, in a completely open configuration, in which one of the two half-shells is swung back by about 180°.
Figure 9:
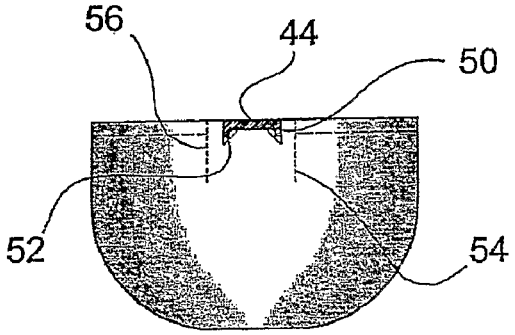
FIG. 9 is a sectional view along the line IX-IX in FIG. 8.
Figure 10:
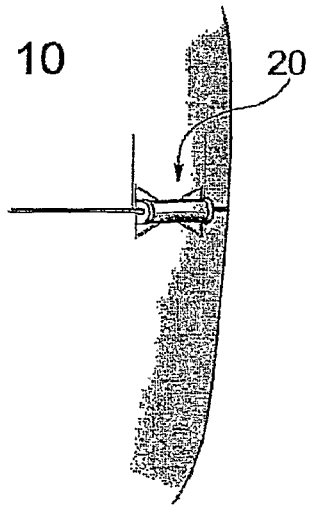
FIG. 10 is an enlarged detail of the container in FIG. 7.

This solution is illustrated and can be seen in the cross-section in FIG. 6 and in the views in FIGS. 3 and 8.

The thickening of the wall does not necessarily have to apply to the whole angular extension of the neck 14 and where appropriate the skirt 4*b*, but is preferably limited to an angular area which extends by an angle of less than 360°, for example equal to or less than 180°, on the opposite side relative to the hinge means 20 as indicated by $\alpha$ in FIGS. 3 and 8.

In the preferred embodiment shown in the drawings, in order to make the container easier to snap open and shut, the inner surface of the skirt portion 2*b* of the half-shell 2 has, in vertical section, a curved shape 34 (FIG. 6) and, correspondingly, the outer surface 36 of the neck 14 has a complementary curved shape.

In particular, as can be seen in FIGS. 1 and 6, the container has in a cross-section along a vertical plane passing through the axis b-b (FIG. 4), orthogonal to the hinging axis a-a, in the area on the opposite side relative to the hinging means 20, a curved or convex meridian shape.

From this it follows that in the preferred embodiment, both the inner surface 34 and the outer surface 38 of the skirt portion 2*b* have a curvature at least in an area on the opposite side relative to the hinging means 20.

Correspondingly, the outer surface 36 of the neck 14 and the outer surface 40 of the skirt portion 4*b* of the half-shell 4 have a radius of curvature in the above-mentioned area on the opposite side relative to the hinging means.

The inner surface 42 of the neck 14 and of the skirt portion 4*b* may however be substantially cylindrical surfaces.

Inside the container 1 there is generally arranged a gift article indicated by the letter R. After the gift item has been positioned, the container is snapped shut by causing the skirt area 2*b* to be superimposed on the neck 14 with the rib 16 engaging positively with the complementary groove 18.

The container is opened by applying a tensile force to the half-shell 2, or compression or crushing of the side wall 4*b*, thus causing the hinge means 20 to snap open as a result of the disengagement of the rib 16 and groove 18.

Because of the characteristics described previously, the container according to the invention is more compact and easier to handle and can be easily managed and manipulated by the user.

It should be understood that, the principle of the invention remaining the same, the embodiments and details of construction may be varied widely with respect to those described and illustrated, without thereby departing from the scope of the claims which follow.

Thus, it should be understood that other snap-action hinge means which differ from those described previously and which achieve the same functions described above may appropriately be used.

Thus one possibility would be to have two or more integral hinge means separated or at an angular distance from each other.

Similarly, although the container is described here with reference to a generally cylindrical configuration with a substantially circular cross-section, it should be understood that the configuration may be varied by altering the mouth and wall shapes of the two half-shells, for example to include a generally ovoid configuration, formed by two half-shells having an ovoid mouth outline or by two half-shells with a circular mouth outline which, when joined together, jointly form a container having an ovoid configuration.

Furthermore, the term half-shell as used in the present description should not be understood as limited to markedly concave half-shells both having a containing function. In fact, the scope of the invention should be taken to include a case in which at least one of the two half-shells is of generally flattened form, substantially acting as a lid for the other half-shell.

The invention claimed is:

1. A container for products comprising a first half-shell and a second half-shell each having a cup-like configuration with a containing wall and an open mouth, wherein the containing wall of the first half-shell has a neck portion that defines said mouth and is insertable to fit into the mouth of the containing wall of the second half-shell, wherein the first and second half-shells are capable of being joined together in a mouth-to-mouth relationship to form a closed container, wherein the first and second half-shells are hinged to each other along a main hinging axis by a hinge means integral with the first and second half-shells, so that the second half-shell acts as a lid and is movable relative to the first half-shell between a closed position of the container and an at least partially open position of the container, wherein said hinge means comprises a hinge film element which is connected to the first half-shell below said neck portion and to the mouth outline of the second half-shell, wherein the second half-shell has on its containing wall weakening lines extending directly from the mouth outline of the second half-shell for a predetermined length of the containing wall of said second half-shell, wherein each of said weakening lines is arranged adjacent to a respective end of said film hinge, wherein said weakening lines are configured to break, as the result of loads applied to said second half-shell, before breakage of the film hinge element to create a flexible flap between said weakening lines, and wherein the flap connects the containing wall of the second half-shell to the film hinge element.

2. The container according to claim 1, wherein said integral hinge means comprises a further film hinge element which extends parallel to the main hinging axis connected to the first and second half-shells by means of connecting elements.

3. The container according to claim 1, wherein said integral hinge means comprises a flexible film hinge element connected to the containing walls of the first and second half-shells along curved segments and having at its longitudinal ends elastic flexible elements in the form of ribs.

4. The container according to claim 1, wherein said neck portion of the first half-shell and said containing wall portion of the second half-shell have means for fitting positively together.

5. The container according to claim 1, said neck portion of said first half-shell is capable of being inserted to fit into an annular wall portion of the second half-shell, and at least one angular area of said neck portion has a greater wall thickness with respect to the wall thickness of a skirt portion of the second half-shell.

6. The container according to claim 1, wherein said half-shells have flexible walls capable of elastic deformation, such that a radial compression force applied to the containing wall of at least one of the half-shells and capable of causing it to undergo elastic crushing deformation, with the container closed, is capable of causing the container to snap open.

7. The container according to claim 1, wherein said hinge means and said first and second half-shells are in one-piece.

8. Packaging made of food product containing inside it the container according to claim 1 enclosing a gift or surprise article.

9. Packaging according to claim 8, wherein the packaging is a chocolate egg packaging.

10. The container according to claim 1, wherein at least one containing wall portion or skirt portion of said second half-shell is flexible or elastic in bending.

11. The container according to claim 10, wherein said containing wall portion or skirt portion of said second half-shell has greater flexibility or elasticity in bending with respect to that of at least one angular area of the containing wall of the first half-shell.

12. The container according to claim 11, wherein said first half-shell has at least one containing wall portion adjacent to said neck portion having a greater wall thickness with respect to the wall thickness of the second half-shell, at least in one angular area of said first half-shell arranged on the opposite side with respect to the integral hinge means.

13. The container according to claim 1, wherein, in cross-section along a vertical plane that is orthogonal to the main hinging axis, the container has a curved meridian shape.

14. The container according to claim 13, wherein said second half-shell has a skirt portion having in vertical section a curved shape, and said neck portion of said first half-shell has a curved shape corresponding substantially to said curved shape of the second half-shell.

15. The container according to claim 14, wherein said skirt portion and said neck portion have a curved vertical shape extending for an angular area of less than 180° on the opposite side with respect to the hinge means.

16. The container according to claim 1, wherein said integral hinge means comprises at least one intermediate element connected to the containing wall of the first half-shell by means of a first film hinge and to the containing wall of the second half-shell by means of a second film hinge in which said first and second film hinges are divergent from each other and extend obliquely relative to the main hinging axis between the first and second half-shells.

17. The container according to claim 16, wherein said intermediate element or elements are elements having substantially no tensile elasticity.

18. The container according to claim 16, wherein said integral hinge means comprises a second pair of film hinges connected respectively to first and second half-shells and connected to each other by a second intermediate element.

19. The container according to claim 18, wherein the film hinges of said first pair and of said second pair converge with each other and intersect substantially at a point on said main hinging axis.

20. The container according to claim 19, wherein said at least one intermediate element have a lower tensile elasticity with respect to the tensile elasticity of said film hinges of said first pair and of said second pair.

* * * * *